United States Patent [19]

Iwata

[11] 4,249,288

[45] Feb. 10, 1981

[54] APPARATUS FOR TREATING FABRIC BY BEATING WHILE FABRIC IS IN THE SPREAD OR FLATTENED STATE

[76] Inventor: Shozo Iwata, 44, Aza Kitagawara, Menjo, Yamatocho, Ichinomiya-shi, Japan

[21] Appl. No.: 22,062

[22] Filed: Mar. 19, 1979

[30] Foreign Application Priority Data

Mar. 27, 1978 [JP] Japan ..... 53-35019

[51] Int. Cl.[3] ..... D06C 17/04; D06C 15/14; D06C 27/00

[52] U.S. Cl. ..... 26/22; 26/25; 26/26; 28/116

[58] Field of Search ..... 26/22, 25, 26; 28/116

[56] References Cited

U.S. PATENT DOCUMENTS

| | | | |
|---|---|---|---|
| 253,161 | 1/1882 | Doubleday | 26/25 |
| 2,902,746 | 9/1959 | Bateman | 28/107 |

FOREIGN PATENT DOCUMENTS

| | | | |
|---|---|---|---|
| 19393 | of 1897 | United Kingdom | 26/22 |
| 418754 | 10/1934 | United Kingdom | 26/25 |

*Primary Examiner*—Robert Mackey

*Attorney, Agent, or Firm*—Norbert P. Holler; Charles A. Blank

[57] ABSTRACT

Apparatus for treating fabric by beating while the fabric is in the spread or flattened state, particularly for use in a process and system for washing the fabric. The apparatus has a large number of beating bars arranged in groups each of which being adapted to effect a beating, in cooperation with beating anvils, on the fabric which is carried and fed by an endless rubber base running on the beating anvils. The driving mechanisms for the feed of the fabric and for the beating are operatively connected such that the feed and the beatings are made alternately. For washing the cloth, the cloth is immersed in the solution of a detergent, and is then beaten by the first group of beating bars. Subsequently, the fabric is beaten by the second group of beating bars under application of washing with hot water or water. The apparatus of the invention can treat thin fabrics such as gauze, and can ensure a high soft feel or touch of the finished fabric, due to the application of the beating.

2 Claims, 6 Drawing Figures

APPARATUS FOR TREATING FABRIC BY BEATING WHILE FABRIC IS IN THE SPREAD OR FLATTENED STATE

BACKGROUND OF THE INVENTION

The present invention relates to a method of and apparatus for treating fabrics by beating, while keeping the fabrics in a spread or flattened state.

Hitherto, various methods have been proposed and used for washing woven and knit fabrics of natural and synthetic fibers and fibers obtained by mix spinning of natural and synthetic fibers. These conventional methods are, for example, rope washing method, wide-breadth washing method, vibration method, drum washing method and so forth.

It is impossible, however, to wash thin fabrics such as gauze without disturbing the arrangement of warps and wefts, by these conventional washing methods. In addition, these conventional methods cannot always provide sufficient washing effect, and consume considerably large amounts of water per unit length, e.g. one meter, of the fabrics.

SUMMARY OF THE INVENTION

Under these circumstances, the invention aims at providing a method of and apparatus for beating various woven or knit fabrics of natural fibers, synthetic fibers or mix-spun fibers of natural and synthetic fibers. These fabrics may be woven or knit fabrics of wool fibers such as worsted fibers, e.g. georgette, gabardine and serge, woolen fibers, e.g. tweed, flannel or overcoat fabric, and other knit fabrics. According to the invention, the fabric is transferred in a spread or flattened state at a speed of about 8 to 30 meters per minute, and is beaten in the course of the transfer by beating bars at a rate of 200 to 800 beats per minute, so that, under the presence of a solution of detergent, hot water or water, a sufficiently large washing effect is obtained to remove any contaminants. At the same time, according to the invention, the milling or felting of the fabric is effected under optimum conditions, without causing any wrinkling of the fabric, so as to ensure a superior feel or touch of the fabric, because the fabric is subjected to the beating in a spread or flattened state.

To these ends, according to the invention, there is provided an apparatus for beating a fabric while the fabric is in a spread or flattened state, characterized by comprising; an anvil bed resiliently supported for free adjustment of level by means of a plurality of pneumatic cylinders and associated springs; a pair of guide rolls disposed at respective sides of the anvil bed; a large number of beating anvils disposed side by side on the anvil bed and between the guide rolls; an endless rubber base for transferring or feeding a fabric stretched between said guide rolls; a large number of beating bars of a desired polygonal cross sectional disposed above the beating anvils and the rubber base in vertical alignment with the beating anvils; means for vibrating the beating bars in the vertical direction by an eccentric crank motion; and drive coupling means including a one-way clutch adapted to operatively connect the means for vibrating the beating bars to one of the guide rolls, so as to drive the rubber base such that the transfer or feed of the fabric is stopped when the beating bars are lowered to beat the fabric and that the fabric is transferred or fed when beating bars move upwardly from the fabric.

According to another aspect of the invention, there is provided a method of beating a woven or knit fabric while the fabric is in the spread or flattened state, characterized by comprising the steps of; immersing the fabric in a solution of a detergent or jetting the solution onto the fabric, effecting beating on the fabric by means a group of a plurality of beating bars of desired polygonal cross section from the upper side of the fabric, in such a manner that the transfer or feed of the fabric and the beating by the beating bars are made alternately, and effecting beating on the fabric by a group of a plurality of the said beating bars while jetting hot water or water onto the fabric.

These and other objects, as well as advantageous features of the invention will become more clear from the following description of the preferred embodiments taken in conjunction with the accompanying drawings.

DESCRIPTION OF THE PREFERRED EMBODIMENTS

Figure 1:
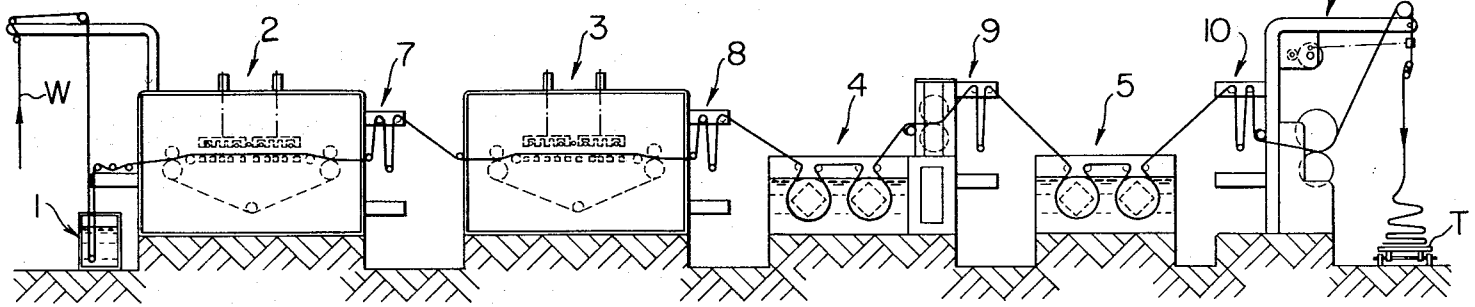
FIG. 1 is an illustration of a complete washing system incorporating a fabric beating apparatus of the invention.

Referring first to FIG. 1, a washing system incorporating a fabric beating apparatus of the invention has a detergent bath 1 containing a detergent into which the fabric to be washed is immersed, fabric beating apparatus 2, 3 of the invention, washing machines 4, 5 for washing the fabric with hot water or water, and a device 6 for liquid extraction and delivering the fabric in a folded form. Reference numerals 7, 8, 9 and 10 denote, respectively, groups of rollers each of which having a plurality of rollers arranged in an offset or staggered manner. The speeds of rollers of these groups are suitably controlled by combinations of variable speed motor and variable resistor, such that suitable transfer speed of the fabric is maintained between successive constituents or stations of the washing system. The fabric W to be washed is made to pass the constituents or stations of the washing system successively from the left to the right as viewed on the drawing, in a spread or flattened state. After the washing, dehydration or liquid extraction, the fabric is folded onto a track T. The constituents or stations other than the beating apparatus 2, 3 are of known type, and therefore, except an explanation that the washing machines 4, 5 are of a type as having a pair of rotary mesh drums accommodating rectangular rotary bodies, the rotation of which generate jets of hot water or water which pass through the fabric W on the mesh drums to carry contaminants away, other explanations of the known constituents are omitted.

Hereinafter, a fabric beating apparatus of the invention will be described in detail, with reference to FIGS. 2 and 3.

An anvil bed 23 is resiliently supported at its four corners by means of springs 22 mounted on pneumatic cylinders 21. The pneumatic cylinders are intended for adjusting the level of the anvil bed 23, so as to adjust the pressing force exerted by later-mentioned beating bars during the beating operation. A number of beating anvils 24 are disposed on the anvil bed 23, in side-by-side relation. Guide rolls 25, 25' are rotatably supported by the machine frame, at both sides of the anvil bed 23. An endless rubber base 26 is stretched between these guide rolls 25, 25', and extends above the beating anvils 24.

Figure 3:
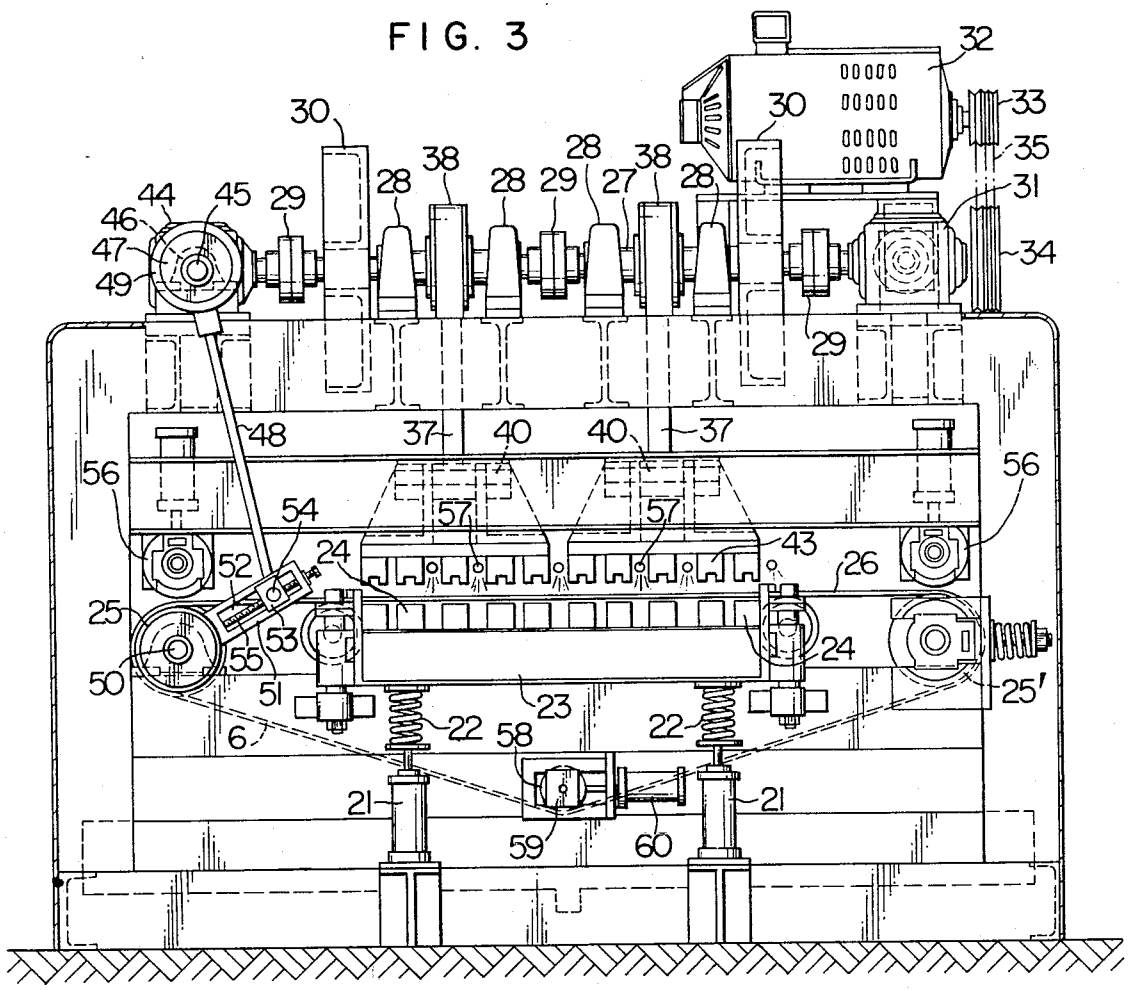
FIG. 3 is a side elevational view of the fabric beating apparatus as shown in FIG. 2.

As will be seen from FIG. 3, a drive shaft 27 is rotatably supported by four bearings 28, at an upper portion of the machine frame. In FIG. 3, reference numerals 29, 30 and 31 denote, respectively, couplings, fly-wheels and a gear box. Also, an electric motor having a pulley 33 is designated at 32. A belt 35 is stretched between the pulley 33 of the motor 32 and a pulley 34 of the gear box 31.

Figure 2:
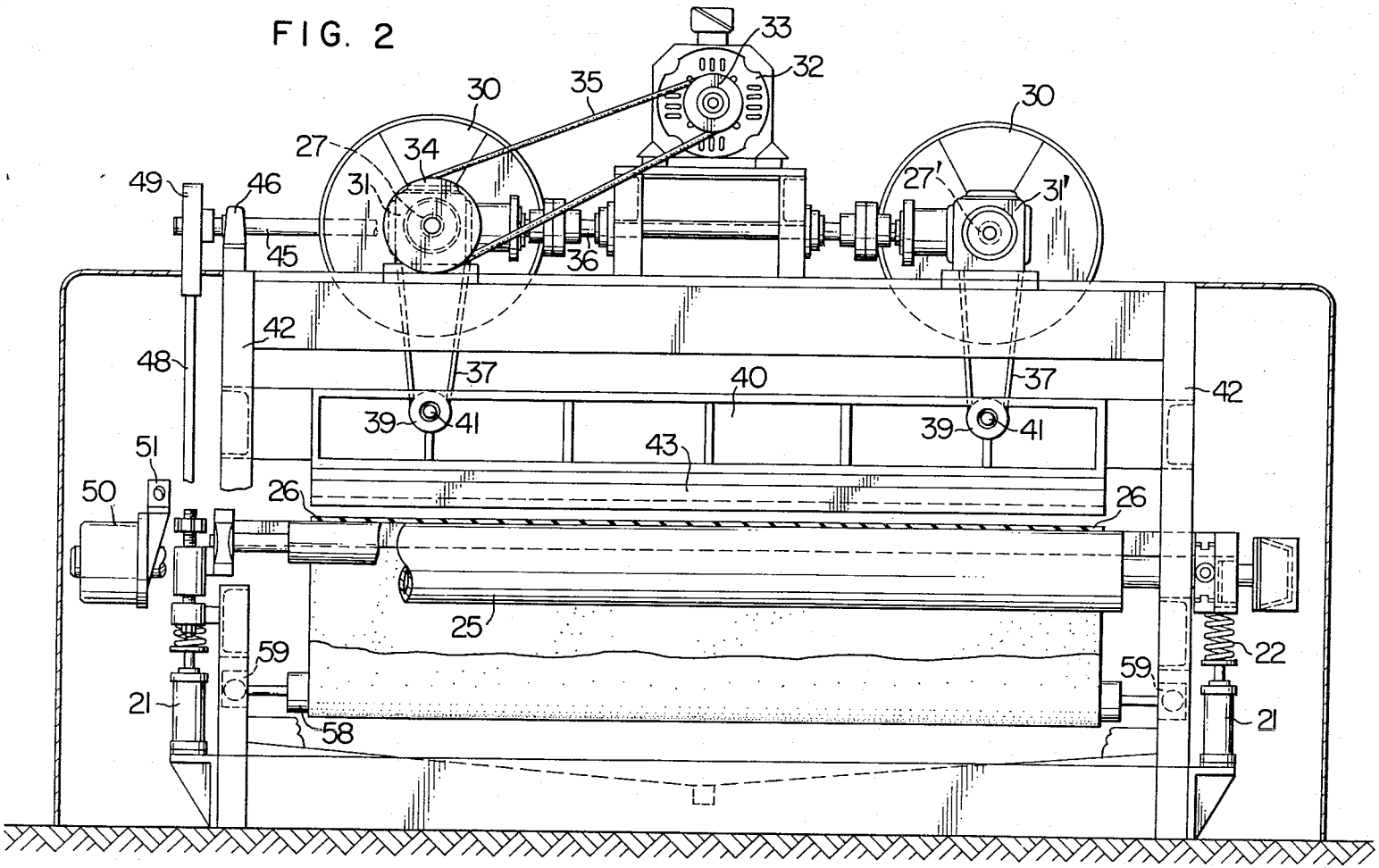
FIG. 2 is a front elevational view of a fabric beating apparatus embodying the invention.

As shown in FIG. 2, one drive shaft 27 (27') is disposed at each side of the motor 32, in parallel with each other. The left-hand side gear box 31 is connected to the right-hand side gear box 31' by means of a drive coupling shaft 36. The arrangement is such that, as a driving torque is transmitted to the left-hand side gear box 31 through the pulley 33 of the motor, belt 35, and the pulley 34 of the gear box, the driving torque is further transmitted to the right-hand side gear box 31' through the drive coupling shaft 36, so that both drive shafts 27, 27' are rotated at an equal speed. Referring to FIG. 3, two eccentric wheels (not shown) are attached to each of the drive shafts 27, 27'. Each eccentric wheel rotatably carries the large end portion 38 of a connecting member 37. The small end portions 39 of these connecting members are pivoted to pins 41 provided on beating bar supports 40, as shown in FIG. 2.

The beating bar supports 40 are slidably received by vertical guide grooves formed in guides 42. Thus, a pair of beating bar supports 40 as shown in FIG. 3 are suspended at two points from corresponding eccentric wheels on both driving shafts 27, 27', through the connecting members 37 and the pins 41, so as to be moved reciprocatingly in the vertical direction, along the guides 42, as the drive shafts 27, 27' are rotated. To the lower surface of each beating bar support 40 are attached five beating bars 43. These bars 43 are disposed in side-by-side relation in vertical alignment with beating anvils 24. Each of the beating bars 43 has two axially-extending protrusions in its surface opposed to the beating anvil.

Referring now to FIG. 3, the drive shaft 27 is coupled at its left-hand side end to a gear box 44. The gear box 44 accommodates gears by which the torque delivered by the drive shaft 27 is transmitted for driving the endless rubber base 26, through a shaft 45 which makes an angle of 90° to the drive shaft 27. To the outer end of the shaft 45 supported by a bearing 46, attached is an eccentric wheel 47 for a unitary rotation with the shaft 45, and is rotatably embraced by the large end portion 49 of a connecting rod 48. The small end portion of the connecting rod is pivoted to a pin 54 which is fixed to a nut 53 adjustably slidable along a groove 52 formed in the arm 51 of a one-way clutch 50. The position of the nut 53 can be adjusted by means of a screw rod 55. The eccentric wheel 47 is attached to the shaft 45 in the same phase of rotation as the eccentric wheels embraced by the large end portions 38 of the connecting members 37. Therefore, as the beating bars 43 are lowered, the connecting rod 48 is lowered simultaneously, and raised in synchronization with the raising of the beating bars so as to swing the arm 51 upwardly. The one-way clutch 50 is adapted to drive the guide roll 25 in one direction only during the raising of the connecting rod, i.e. during the raising of the beating bars 43, and not to drive the same during the lowering of the connecting rod, i.e. during the lowering of the beating bars. The arm 51, nut 53 and the screw rod 55 in combination constitute means for adjusting the speed of movement of the endless rubber base 26. Namely, the moving speed of the endless base 26 can be adjusted through changing the driving speed of the guide roll 25, by changing the effective length of the arm 51. In FIG. 3, reference numerals 56 and 57 denote, respectively, squeezing rolls and pipes for jetting washing liquid. A correcting roll 58 as shown in FIG. 2 is adapted to correct the lateral displacement of the rubber base 36, and is supported at its both ends by spherical bearings 59. The arrangement is such that, as a lateral displacement of the rubber base 26 is detected by a feeler not shown, a pneumatic cylinder 60 (See FIG. 3) connected to one of the spherical bearings is energized to swing the correcting roll 58 horizontally around the other spherical bearing, thereby to correct the lateral displacement of the rubber base.

Hereinafter, the operation of the washing system, particularly of the beating apparatus of the invention will be described.

Referring to FIG. 3, as the motor 32 is started, the fabric which has been passed through the detergent bath and impregnated with the detergent is transferred from the right to the left as viewed on FIG. 3, after having been squeezed slightly by the squeezing roller 56, by the intermittent drive of the rubber base 26 performed through the action of the eccentric wheel 47, connecting rod 48, one-way clutch 50 and the guide roll 25, at a speed of 8 to 30 meters per minute. At the same time, the large number of beating bars 43, attached to the lower ends of two beating bar supports 40 suspended from the eccentric wheels on the drive shafts 27, 27' through the connecting members 37, are driven to beat the fabric efficiently at a rate of 200 to 800 beats per minute, in accordance with the rotation of the drive shafts. Since the one-way clutch 50 acts to stop the feed of the fabric during lowering of the beating bars and to allow the feed when the bars leave the fabric after the beating, the feeding operation and the beating operation are repeatedly performed alternatingly, such that the fabric is fed, beaten, fed and then beaten again.

In the illustrated embodiment, five beating bars, each having two protrusions for efficient beating along two lines, are used as a unit. The beating performed by the beating bars under the presence of the washing liquid from the jet pipes 57 provides the following two effects.

(1) To expel or force the contaminants out of the fabric (2) To soften the fibers of the fabric As a result, a good cleaning effect is achieved to efficiently remove any contaminants. At the same time, since the fabric is treated in a spread or flattened state, no wrinkles form on the fabric either during or after the treatment, and also a good milling or felting effect is achieved under the best treating conditions. The fabric thus treated is then slightly squeezed by the squeezing roll 56 shown at left-hand side end of FIG. 3, and is forwarded to the subsequent rinsing step.

Figure 4A:
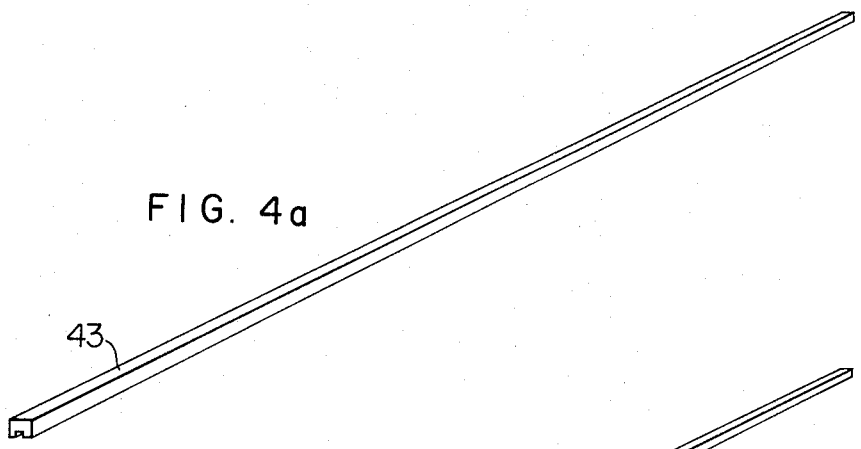
FIG. 4*a* is a perspective view of a beating bar for use in the fabric beating apparatus of the invention, having two axially-extending protrusions in its beating surface.
Figure 4B:
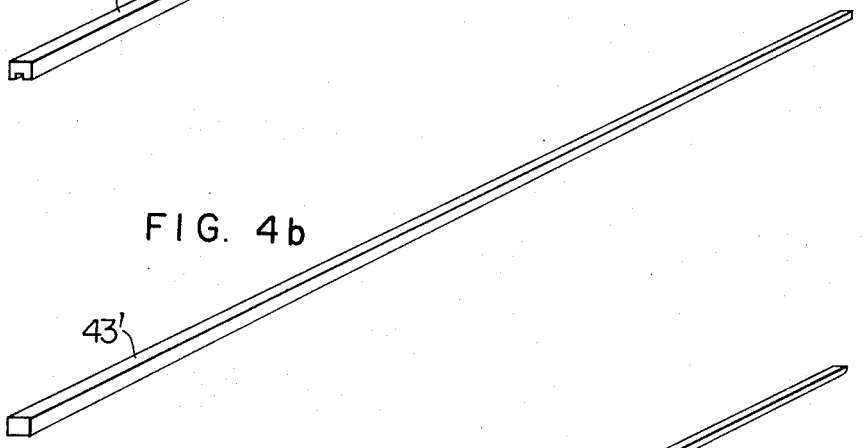
FIG. 4*b* is a perspective view of another beating bar having a flat beating surface.
Figure 4C:
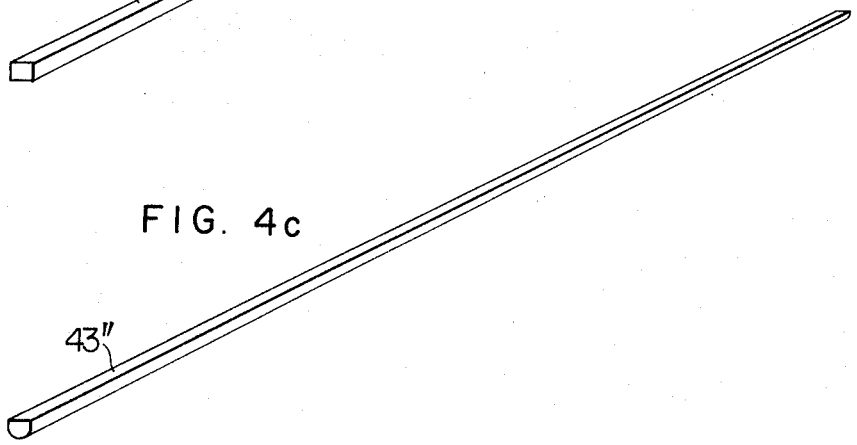
FIG. 4*c* is a perspective view of still another beating bar having a beating surface of an arcuate cross-section.

In the described embodiment, the beating bar 43 has two axially-extending protrusions in its beating surface, as shown in FIG. 4*a*. However, needless to say, it is possible to use various other beating bars in accordance with the nature of the fabric to be treated. For example, a beating bar having a flat beating surface as shown in FIG. 4*b* and a beating bar having an arcuate-cross-sectioned beating surface as shown in FIG. 4*c* may be used.

Hereinafter, a description will be made as to an example of a process for beating fabrics making use of the beating apparatus of the invention.

EXAMPLE

Worsted fabrics such as georgette, gabardine, serge or the like, and woolen fabrics such as flannel, overcoat fabric or the like were used as the fabrics to be treated. The beating was effected by means of a beating apparatus having a pair of groups of beating bars, each including five beating bars 20 millimeters wide and 20.00 millimeters long and each bar having two axially-extending protrusions in its beating surface. The beating was conducted at a rate of 500 beats per minute, i.e. 8.3 beats per second, while the speed of transfer or feed of the fabric was 20 meters per minute, i.e. 0.3 meters per second.

Then, after immersing the fabric in a solution of detergent prepared in accordance with the following prescriptions (1) or (2) and a jetting of the same onto the fabric, the contaminants were removed by the above-mentioned beating apparatus.

| | | |
|---|---|---|
| Prescription (1) | | |
| Soap | 1% | |
| Higher alcohol | 2% | |
| Water | 97% | |
| Prescription (2) | | |
| Nonionic surface active agent | | 1% |
| sodium carbonate | | 2% |
| Water | | 97% |

Subsequently, the fabric was treated in another beating apparatus of the same construction in which hot water of 50° to 60° C. was jetted to the fabric at a rate of 100 liters per minute, while continuing the beating under the same conditions. Afterwards, the fabric was subjected to a rinsing and then finally dried.

The washing effect provided by the beating apparatus and method of the invention was compared with that of a conventional rope washing method which consists in washing the fabric in a bundled condition in the form of a rope. The sum of the residual fat content % and the residual soap content % was used as the index of the comparison. The result of this comparison is summarized in the table shown below.

| item | fabric (%) | conventional method (%) | method of invention (%) |
|---|---|---|---|
| worsted gabardine (piece dyeing) | 1.89 | 0.9 | 0.85 |
| worsted georgette (piece dyeing) | 1.87 | 1.72 | 1.06 |
| worsted milled serge (yarn dyed) | 1.80 | 1.44 | 0.81 |
| woolen flannel (yarn dyed) | 4.15 | 3.18 | 2.39 |
| woolen overcoat fabric (yarn dyed) | 3.91 | 3.48 | 2.81 |
| woolen overcoat fabric (piece dyeing) | 5.16 | 3.60 | 3.06 |
| woolen overcoat fabric (piece dyeing) | 3.80 | 3.70 | 2.98 |

From the above table, it will be understood that the best treating method of the invention provides a superior washing effect to that provided by the conventional method.

To sum up, the present invention offers the following advantages.

(1) A superior washing effect is obtained as compared with conventional washing techniques. In addition, since the washing is effected in a short time with continuous beating, the amount of water consumed per unit length of the fabric is remarkably reduced. For instance, the washing by the method of the invention requires only 10 liters of water per 1 meter of the fabric, whereas the conventional method consumes 50 liters of water for the same length of the fabric.

At the same time, it is remarkable that the fabric can be finished to have a good soft feel and touch, while completely avoiding the generation of wrinkles.

(2) Conventional rope washing method, wide breadth method, vibration method and drum method require a bundling of fabrics into the form of a rope, or to subject the same to a strong squeezing operation under the presence of water in the nip of the squeezing rollers. It is therefore impossible to wash thin fabrics such as gauze without causing a disturbance of the lattice-like arrangement of the warps and wefts. However, according to the invention, it is possible to obtain a good washing effect without disturbing the structure of the fabric, due to the application of the beating.

(3) It is an essential feature of the invention that the apparatus is so constructed that the feeding of the fabric and the beating on the fabric are effected alternatingly but not simultaneously.

The described and illustrated embodiments are not exclusive, and various changes and modifications are possible within the scope of the invention.

For instance, the water and hot water are greatly saved by arranging such that, in the system as shown in FIG. 1, the hot water used in the washing machine 4, which is comparatively clean, is supplied to the beating apparatus 3 of the invention for repeated use, and that the washing hot water or water is supplied in the opposite direction to the feed of the fabric, i.e. in a counter flow manner.

What I claim is:

1. An apparatus for beating a fabric while the fabric is in a spread or flattened state, comprising: an anvil bed; means for resiliently supporting said bed for free adjustment of level; a pair of guide rolls disposed at respective sides of said anvil bed; a plurality of beating anvils disposed side by side on said anvil bed and between said guide rolls; an endless rubber base for transferring or feeding a fabric stretched between said guide rolls; a plurality of beating bars of polygonal cross section disposed above said beating anvils and said rubber base in vertical alignment with said beating anvils; eccentric crank means for vibrating said beating bars in the vertical direction; and drive coupling means including a one-way clutch adapted to operatively connect said means for vibrating said beating bars to one of said guide rolls, so as to drive said rubber base such that the transfer or feed of the fabric is stopped when said beating bars are lowered to beat said fabric and that said fabric is transferred or fed when said heating bars are moving upward from said fabric.

2. An apparatus for beating a fabric as claimed in claim 1, wherein said means for vibrating said beating bars vibrates said beating bars with the number or frequency of the beats performed by said beating bars falling within the range of between 200 to 800 beats per minute, while said means for vibrating said beating bars drives said fabric on said rubber base through said drive coupling means with the speed of transfer or feed of said fabric on said rubber base driven through said drive coupling means ranging between 8 to 30 meters per minute.

* * * * *